United States Patent [19]

Carroll

[11] 4,267,678

[45] * May 19, 1981

[54] INSULATED ROOF STRUCTURE

[75] Inventor: Frank E. Carroll, Barrington, Ill.

[73] Assignee: Carroll Research, Inc., Rolling Meadows, Ill.

[ * ] Notice: The portion of the term of this patent subsequent to Jun. 15, 1993, has been disclaimed.

[21] Appl. No.: 696,213

[22] Filed: Jun. 15, 1976

Related U.S. Application Data

[63] Continuation-in-part of Ser. No. 545,303, Jan. 30, 1975, Pat. No. 3,962,841, which is a continuation-in-part of Ser. No. 457,996, Apr. 4, 1974, Pat. No. 3,965,641.

[51] Int. Cl.[3] ..... E04B 1/24; E04C 2/10

[52] U.S. Cl. ..... 52/302; 52/309.12; 52/338; 52/435

[58] Field of Search ..... 52/408, 411, 443

[56] References Cited

U.S. PATENT DOCUMENTS

| | | | |
|---|---|---|---|
| 2,174,581 | 10/1939 | Hoge | 52/408 |
| 2,730,942 | 1/1956 | Peterson | 52/144 |
| 3,203,146 | 8/1965 | Carter | 52/338 |
| 3,269,071 | 8/1966 | Johnson | 52/612 |
| 3,318,063 | 5/1967 | Stone | 52/404 |
| 3,531,901 | 10/1970 | Will | 52/404 |
| 3,619,961 | 11/1971 | Sterrett | 52/309 |
| 3,884,009 | 5/1975 | Frohlich | 52/302 |
| 3,962,841 | 6/1976 | Carroll | 52/434 |
| 3,965,633 | 6/1976 | Carroll | 52/434 |
| 3,965,641 | 6/1976 | Carroll | 52/738 |

*Primary Examiner*—John E. Murtagh
*Attorney, Agent, or Firm*—Thomas W. Speckman

[57] ABSTRACT

A poured concrete insulated deck structure comprising a series of parallel sub-purlins having horizontal flanges extending outwardly at the lower portion of the sub-purlin, a temperature resistant, moisture permeable formboard resting on flanges between adjacent sub-purlins, the formboard having secured to its upper surface rigid synthetic polymer foam having spaces vertically therethrough providing communication from the upper side of the formboard to the upper side of the foam, spaces having an area of more than about 5 percent of the area of the formboard, and poured concrete adjacent the upper side of the foam and extending through the spaces contacting the upper side of the formboard, the concrete completing drying by escape of moisture through the formboard. The structure of this invention results in a unitized structure affording high strength, high insulation properties, fire resistance, design versatility and economy.

3 Claims, 2 Drawing Figures

INSULATED ROOF STRUCTURE

CROSS REFERENCE TO RELATED APPLICATIONS

Figure 1:
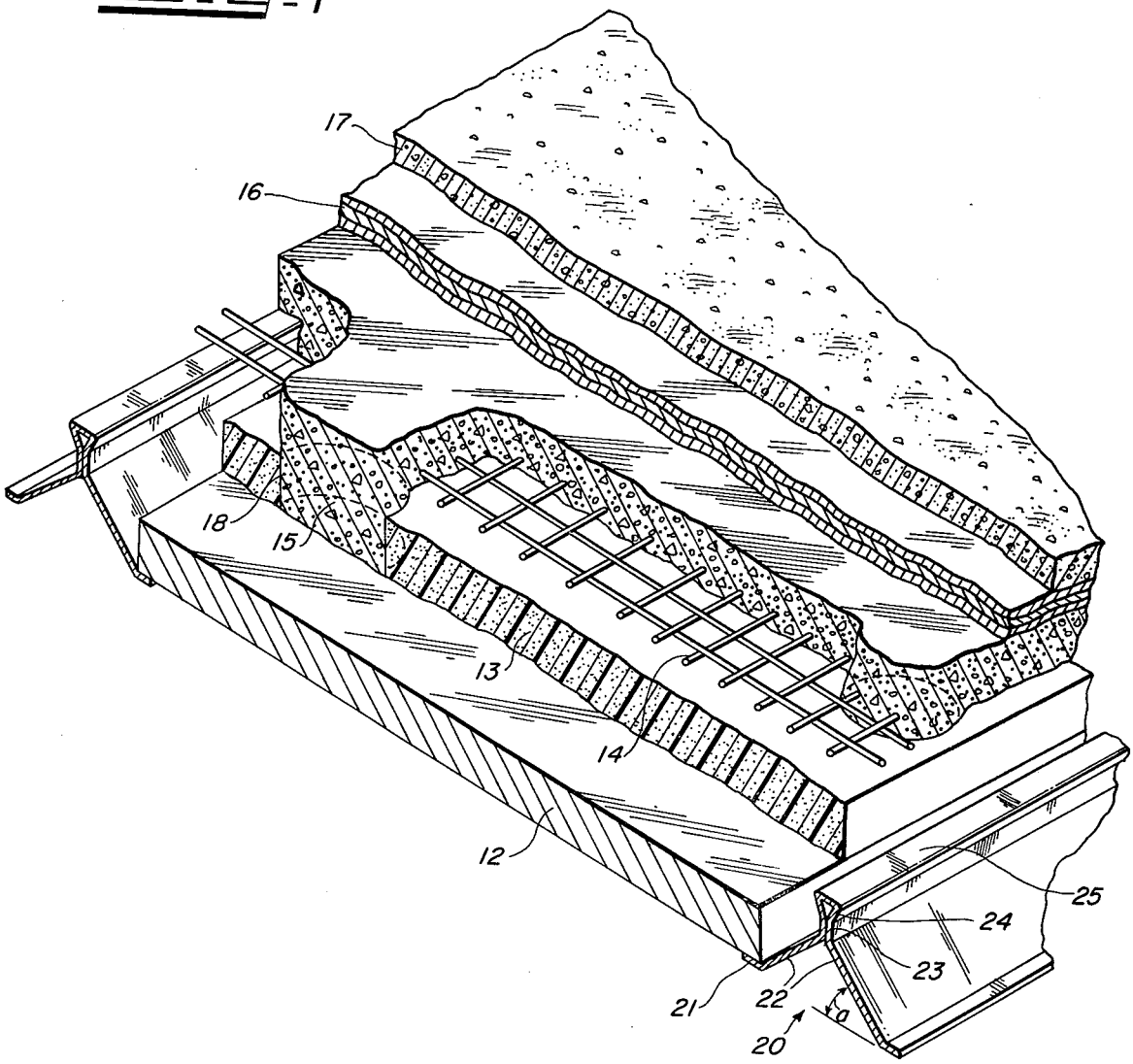

This application is a continuation-in-part of pending application Ser. No. 545,303, filed Jan. 30, 1975, to issue as U.S. Pat. No. 3,962,841 on June 15, 1976, which is a continuation-in-part of Ser. No. 457,996, filed Apr. 4, 1974, to issue as U.S. Pat. No. 3,965,641 on June 29, 1976.

This invention relates to an insulated deck structure providing superior fire protection and insulation properties. The deck structure of this invention is generally a poured concrete deck, reinforced with wire mesh, wherein formboard is secured to synthetic organic polymer foam having open spaces vertically therethrough to permit the poured concrete to penetrate to the formboard at selected intervals. The structure of this invention results in a unitized structure affording high strength, high insulation properties, fire resistance, design versatility and economy.

The structure of this invention incorporates the insulation within the structural portion of the deck system as opposed to most conventional presently used methods of utilization of roofers insulation. Roofers insulation is applied over the structural portion of the roof deck and is not entirely satisfactory since it is located just beneath the weather seal and tends to be damaged and to retain water from breaks in the weather seal. Additionally, when the weather seal is replaced, the insulation is frequently damaged. In the structure of this invention, the insulation is between the poured deck and formboard.

To obtain most efficient integral insulation properties, prior to this invention conventional metal roof decks were installed followed by foam insulation covered with a weatherproof barrier or traffic layer, such as bitumen and roofing felt. However, such structures do contribute to the spread of a fire in a building under such a metal roof deck. U.S. Pat. No. 3,466,222 is illustrative of recent attempts to overcome such disadvantages. However, the structure shown in the U.S. Pat. No. 3,466,222 patent only slows down fire damage and does not eliminate it, the roof being susceptible to total destruction by the foam disintegrating and permitting the weatherproofing materials to burn even when utilizing an expensive metal deck roof system.

Poured concrete deck systems have long been recognized as economical and furnishing a fireproof deck structure. In the conventional poured deck system, gypsum formboard is laid over the steel sub-purlin assembly, a layer of interwoven steel reinforcing mesh placed over the gypsum formboard and poured in place slurry of gypsum concrete applied to conventionally two inches thick. Such roof systems are known to provide satisfactory two hour fire ratings and low flame spread ratings. However, attempts to provide insulation to such roof deck systems has not proved satisfactory. One attempt has been to use perlite aggregate in the gypsum concrete, however, this does not give desired insulation properties. Another attempt has been to provide insulation beneath the roof deck structure. However, such insulation either adds to combustion in the interior of the building or is expensive if incombustible mineral fiber is used. Other attempts to provide both satisfactory insulation and fireproof properties have been to utilize formboard which is both incombustible and has insulating properties. Such formboards are those manufactured from mineral fiber materials and fiberglass materials, but these are both expensive and do not provide the desired insulation properties while being more difficult to use in field erection. Also, while fiberglass is incombustible it does not provide any hourly fire rating.

In previous poured concrete deck structures, the sub-purlins have been bulb tees which have been available in only 2⅝ inch maximum depths and truss tees which have recently become available in depths up to 3 inches. Sheet metal roll formed sub-purlins, such as exemplified in my co-pending application Ser. No. 457,996 to issue as U.S. Pat. No. 3,965,641 on June 29, 1976, have become available in heights of 3 inches and may readily be utilized as sub-purlins in heights up to 4 to 6 inches to accommodate greater insulation in accordance with this invention. I have found that it is desirable for the formboard-insulation assembly thickness not to exceed the heights of the sub-purlins due to the necessity for workmen to walk on the sub-purlin structure for installation of the formboard-insulation and reinforcing mesh and for application of the concrete slab.

It is an object of this invention to overcome the above disadvantages.

It is a further object of this invention to provide an economical, insulating and fireproof poured concrete deck system providing a two hour fire rating.

It is still another object of this invention to provide a poured concrete deck system having integral thermal insulation properties.

It is another object of this invention to provide an insulated lightweight concrete poured deck structure.

Figure 2:
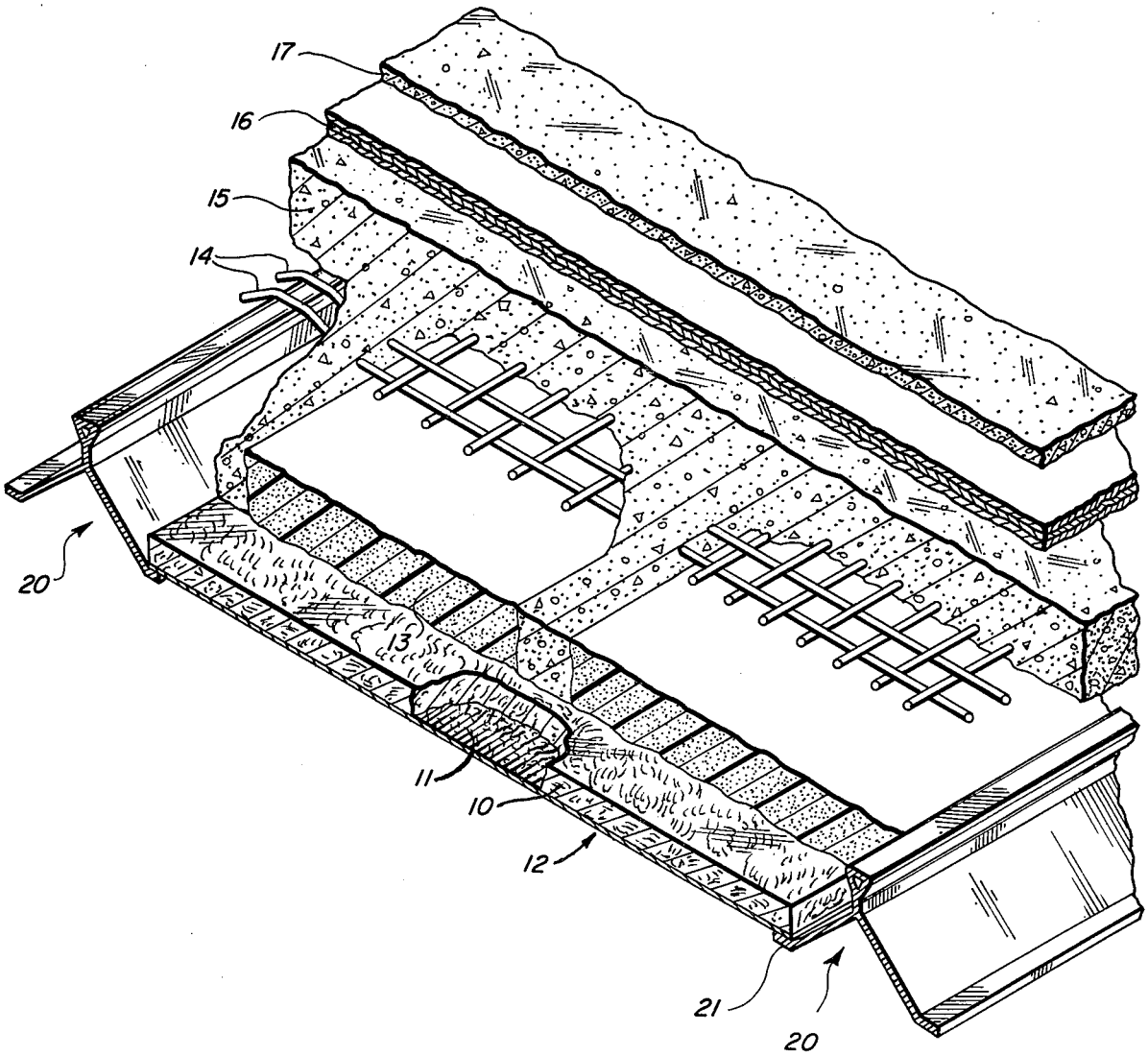

These and other objects, advantages and features of this invention will be apparent from the description and by reference to the drawing wherein preferred embodiments are shown as:

FIG. 1 is a perspective cutaway view of an insulated roofing structure of one preferred embodiment of this invention utilizing sheet metal sub-purlins; and FIG. 2 is a perspective cutaway view of an insulated roofing structure of one preferred embodiment of this invention using mineral fiber formboard.

FIG. 1 shows sheet metal sub-purlins 20 which may be supported by any suitable structural members (not shown) such as open web joists or I beams spaced at proper intervals making a suitable deck support member system. Any deck support member system suitable for support of the concrete deck is satisfactory. The shape of the sub-purlin is not critical, for example, sheet metal shapes as shown in FIG. 1 or truss tees can be used. Formboard 12 having a desired thickness of synthetic organic polymer foam 13 in contact with the upper side of the formboard is utilized in prepared panels supported by the sub-purlins. The synthetic organic polymer foam has open spaces vertically therethrough providing communication between the volume above the polymer foam to the gypsum formboard. It is preferred that the spaces communicating from the volume above the polymer foam to the top surface of the formboard have an area of more than about 5 percent of the area of the formboard. It is preferred that the bottom of the spaces be about 5 to 20 percent of the surface area of the formboard, especially preferred being about 5 to 10 percent of the surface area. It is preferred that the open spaces be provided by holes through the foam of sufficiently large size to permit the concrete to readily flow through to contact the upper surface of the formboard. While it is preferred the holes be round, they may be oval or any other shape allowing flow therethrough of the concrete. The open spaces should be spaced over the surface area of the insulation. Another fashion of providing the open spaces is by application of strips of insulating foam to the formboard with open spaces between the strips. The open space between the strips may be in any desired direction and will further provide a concrete beam effect when filled with concrete as more fully explained in my co-pending application, Ser. No. 567,621, filed Apr. 14, 1975, INSULATED ROOFING STRUCTURE AND METHOD, now U.S. Pat. No. 4,090,336.

Referring to FIG. 1, one sheet metal shape preferred for use in this invention is symmetrical about a vertical bisecting plane. The shape has a central vertical web 23 from which two legs 22 project downwardly for equal lengths at an angle, shown in FIG. 1 as "a", of about 45° to about 75° to the horizontal. Each leg has a substantially horizontal flange 21 projecting outwardly at its lower extremity. The upper edge of web 23 has a structurally stiffening member such as a flange or a triangle. I prefer an inverted isosceles triangle having its vertex at the top of the web and the opposite side substantially horizontal.

Horizontal flange 21 may vary in length suitable to hold the formboard material. I have found from about ½ to about 1 inch to be suitable. The vertical depth of the legs 22 may be varied to suit the strength requirements of the desired span and thickness of insulation and formboard. I have found about 2 to about 4 inches satisfactory when using the shapes as sub-purlins in the deck structure of this invention. The angle of legs 22 with the horizontal are suitably about 45° to about 75°. When used as sub-purlins in this invention, this angle is preferably about 50° to about 60°, about 55° being especially preferred. Web 23 is important to supply vertical strength and also to prevent bending or rolling of the shapes when they are walked upon by erection workers. I have found that regardless of the depth of legs 22, a suitable dimension for web 23 is about ⅜ to ⅝ inch, about ½ inch being preferred. As pointed out above various forms may be utilized as stiffeners on the upper edge of web 23. A preferred shape of stiffener is an inverted isosceles triangle as shown in FIG. 1 having sides 24 and base 25. It is preferred that sides 24 be about 3/16 to about ½ inch, preferably about ¼ inch when the shape is used as a sub-purlin. It is preferred base 25 be about 5/16 to about ½ inch, preferably about ⅜ inch when the shape is used as a sub-purlin. The stiffener at the upper end of web 23 may also be in the form of a horizontal flange, a box shape, or a circular shape. It is desired that the shape permit the poured concrete to flow both under and over the stiffener to prevent vertical displacement or uplift.

Formboards suitable for use in this invention are those moisture permeable formboards which have relatively high melting points and structural resistance to combustion and heat damage when used in the laminated fashion of this invention. Particularly suitable formboards for use in this invention are mineral fiber boards 12 such as mineral fiber structural boards constructed of plastic bonded mineral fibers 10 with an integral glass fiber mat 11 facing reinforced with parallel glass fiber strands as sold by Forty-Eight Insulations, Inc., Aurora, Illinois, under the trademark ALOYGLAS formboard, as shown in FIG. 2 wherein the numerals have the same meaning as FIG. 1 except as noted above. This type of formboard has a melting point at about 1600° F. as compared with conventional fiberglass formboard which melts at about 1050° F. The mineral Fiber formboard used in the structure of this invention should have a density of about 9 to about 12 pounds per cubic foot, preferably about 9 to about 10 pounds per cubic foot. Another suitable mineral fiber formboard is the rigid spun mineral fiber board such as sold by United States Gypsum Company under the trademark THERMAFIBER. Asbestos cement formboards and gypsum formboards having fire resistant additives such as vermiculite or perlite with fiberglass reinforcing are suitable. The above formboards are referred to as high temperature resistant formboard.

I have found that when conventional gypsum formboard, without the high temperature resistant additives, is used in the structure of this invention and high heat results in melting of the synthetic polymer above the formboard, the conventional gypsum formboard has cracked and fallen from its position between the sub-purlins.

The synthetic organic polymer foam may be any substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polyisocyanurate and the like. Preferred foams are selected from the group consisting of polystyrene and polyurethane. Polyurethane due to its higher melting point and higher insulation properties is especially preferred. Particularly suitable foams are closed cell foams which provide high insulating properties and low permeability to moisture. Such organic polymer foams are substantially rigid bodies of foam and are well known for their low density and outstanding thermal insulating properties. However, use of organic polymer foams in roof structures has been limited due to the need for care and special attention in installation if they are used alone and due to their decomposition at higher temperatures permitting structural damage. In accordance with this invention these disadvantages are overcome.

The organic polymeric foam and the formboard are preferably preassembled by fastening the foam to the formboard by use of synthetic and natural adhesives or foaming the polymer in place. Suitable synthetic adhesives include epoxy, polyurethane, polyamide and polyvinylacetate and its copolymers. It is particularly desirable, since many of the formboards particularly suited for this invention are porous, to foam the organic polymer foam in place on top of the formboard in a plant operation. Such techniques are well known to the art. When the foam is foamed in place on top of a porous formboard, the foam will penetrate the pores of the formboard providing good adhesion between the foam and formboard layers and providing good waterproofing for the top surface of the formboard.

Prior to this invention, the preferred mineral fiber formboards could not be used as formboard in thicknesses of less than 2 inches since they tend to be brittle and cannot be physically handled. Further, when concrete was poured on top of such mineral fiber formboards, the water in the concrete made the board weak and the board would fall from its place between the sub-purlins collapsing the roof assembly before it was hardened. The foam both stiffens the formboard assembly of this invention and prevents large quantities of water from reaching a major portion of the formboard thus allowing successful handling of the assembly and pouring of concrete over the top of the assembly while allowing good bottom drying of the concrete. I have found that I can use satisfactorily with poured concrete deck structures, 1½ inch mineral fiber formboards having synthetic organic polymer foam adhered to the upper surface of the formboard according to this invention.

I have found that 9 pounds per cubic foot mineral fiber formboard (ALOYGLAS) having a thickness of 1½ inch with 1½ inch polyurethane foam poured in place laminated on its upper surface with round randomly spaced holes through the foam covering about 6 percent of the foam surface is especially suitable for use in this invention. Especially when using the sheet metal tee as shown in FIG. 1 as a sub-purlin, the foam may be laminated to the edges of the formboard thus providing a unit which may be readily physically handled without damage and providing a base upon which the concrete may be poured without the water weakening the base structure. Further, the sheet metal structural shape as shown in FIG. 1 is particularly suited since the formboard is a sufficient distance from the stiffener at the top of the sub-purlin to permit a large amount of concrete to surround the stiffener and the sub-purlin providing both greater fire resistance to the sub-purlin and lift resistance to the unitized deck structure. When the truss tee sub-purlin is used in this invention, it may be desirable to have the insulation foam cut or sloped back from the edge along the truss tee to permit sufficient concrete to flow into the truss tee structure to provide satisfactory uplift resistance and fire resistance to the truss tee sub-purlin.

Following installation of the gypsum formboard-polymer foam assembly, standard reinforcing wire used in poured concrete deck assemblies, shown as 14, is applied and concrete poured to a suitable thickness of about 1 to about 3 inches over the surface of the polymer foam, about 2 inches being preferred. The poured concrete 15 flows through spaces 18 in the polymer foam and adheres to the upper surface of the gypsum board 12. This structure provides an integral roofing structure having desired fireproof and internal insulation properties.

The concrete utilized may be preferably standard gypsum concrete, however, modified concretes containing various fillers, such as perlite or vermiculite aggregate for thermal insulation and lighter weight are suitable, but not necessary in the deck structure of this invention. Gypsum concrete is especially desirable for use in roof deck structures not only because it is incombustible but also because the gypsum concrete sets within a few minutes to form a slab that is hard enough to walk upon thereby permitting, in many cases, a waterproof wearing surface to be laid the same day the slab is poured. When any type of portland cement is used, the setting time is much slower and the foam-formboard structure of this invention is particularly advantageous in preventing the moisture from sagging the formboard. I have found it may be desirable to place a moisture permeable sheet between the cement and the top surface of the formboard. However, I have found that using the structure of this invention, lightweight concrete may be poured over mineral fiber formboard which, to my knowledge, has not previously been possible. I have found that using the structure of this invention the water dripping from between the formboard sheets is minimized as compared to prior lightweight concrete deck structures.

When the deck structure of this invention is to be used as a roof deck, a built-up roofing membrane may be used as shown in FIG. 1 comprising alternate layers of roofing felt and hot asphalt 16 with a waterproof wearing surface 17 of tar and gravel. Any suitable waterproof wearing surface for flat type roofs is suitable for the roof structure of this invention, or the concrete may be left exposed, such as on dome type roof structures.

The drying of the concrete continues by removal of moisture from the concrete for several weeks after pouring. I have found that in using the roof structure of this invention the drying time of the concrete is not greatly increased. This results from the concrete being in direct contact with the moisture permeable formboard. The continued drying of the concrete after a built-up type roofing membrane is applied to its exterior, continues by the moisture escaping through the formboard.

The deck structure of this invention, particularly roof deck, provides properties which are presently being called for by newer building regulations. The first such property is fire ratings which, following suitable ASTM or Underwriters Laboratories testing, result in two hour fire ratings for the insulated deck structure. The second important property is thermal insulation combined with the satisfactory fire rating. Present energy conservation considerations result in a "U" value of 0.10 and less being desirable. Calculations show that roof deck structures of this invention utilizing the sheet metal shape shown in FIG. 1 as a sub-purlin with 1½ inch ALOYGLAS formboard, 1½ inch polyurethane formboard and 2 inch gypsum concrete with roofing and air film the resistance to upward heat transfer or "R" value is 20.4 resulting in a "U" value of about 0.05. Thus, an inexpensive deck is provided having both a two hour fire rating for Class 1 fire rated construction and insulation properties resulting in "U" values of less than 0.10. Further, a range of desired insulating properties may be achieved by varying the thickness of the synthetic polymer foam.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A poured concrete insulated deck structure comprising:

a series of parallel sub-purlins having horizontal flanges extending outwardly at the lower portion of said sub-purlin;

high temperature resistant, moisture permeable formboard, said formboard being a mineral fiber structural board having plastic bonded mineral fibers with an integral mat facing reinforced with parallel glass fiber strands, resting on said flanges between adjacent sub-purlins, said formboard having secured to its upper surface rigid synthetic polymer foam having spaces vertically therethrough providing communication from the upper side of said formboard to the upper side of said foam, said spaces having an area of about 5 to about 20 percent of the area of said formboard;

poured concrete adjacent the upper side of said foam and extending through said spaces contacting the upper side of said formboard, said concrete completing drying by escape of moisture through said formboard;

reinforcing wire mesh over said foam; and a waterproof wearing surface to the exterior of the poured concrete.

2. The deck structure of claim 1 wherein said mineral fiber formboard has a density of about 9 to about 12 pounds per cubic foot.

3. The deck structure of claim 1 wherein said mineral fiber formboard is a rigid spun mineral formboard.

* * * * *